US009410773B2

(12) United States Patent
Greenwood

(10) Patent No.: US 9,410,773 B2
(45) Date of Patent: Aug. 9, 2016

(54) ADJUSTABLE ARCHERY ARROW INSERT

(71) Applicant: Stephen Greenwood, Brea, CA (US)
(72) Inventor: Stephen Greenwood, Brea, CA (US)
(73) Assignee: Aldila Golf Corp.

( * ) Notice: Subject to any disclaimer, the term of this patent is extended or adjusted under 35 U.S.C. 154(b) by 0 days.

(21) Appl. No.: 14/799,465
(22) Filed: Jul. 14, 2015
(65) Prior Publication Data
US 2016/0010959 A1 Jan. 14, 2016

Related U.S. Application Data
(60) Provisional application No. 62/024,413, filed on Jul. 14, 2014.

(51) Int. Cl.
*F42B 6/08* (2006.01)
*F42B 6/04* (2006.01)

(52) U.S. Cl.
CPC .... *F42B 6/04* (2013.01); *F42B 6/08* (2013.01)

(58) Field of Classification Search
CPC ..... F42B 6/04; F42B 6/08
See application file for complete search history.

(56) References Cited

U.S. PATENT DOCUMENTS

| | | | | |
|---|---|---|---|---|
| 4,210,330 | A | 7/1980 | Kosbab | |
| 4,558,868 | A | 12/1985 | Musacchia | |
| 4,874,180 | A | 10/1989 | Fingerson et al. | |
| 4,943,067 | A | 7/1990 | Saunders | |
| 5,154,432 | A | 10/1992 | Saunders | |
| 5,234,220 | A | 8/1993 | Schellhammer et al. | |
| 5,269,534 | A * | 12/1993 | Saunders | F42B 6/08 403/343 |
| 5,417,439 | A | 5/1995 | Bickel | |
| 5,496,043 | A * | 3/1996 | Ester | F42B 6/08 473/584 |
| 5,516,117 | A | 5/1996 | Rangel | |
| 7,004,859 | B2 | 2/2006 | Palomaki et al. | |
| 7,077,770 | B2 | 7/2006 | Palomaki et al. | |
| 7,115,055 | B2 | 10/2006 | Palomaki et al. | |
| 7,270,618 | B2 | 9/2007 | Palomaki et al. | |
| 7,331,886 | B2 | 2/2008 | Morris et al. | |
| 7,374,504 | B2 | 5/2008 | Palomaki et al. | |
| 7,608,001 | B2 | 10/2009 | Palomaki et al. | |
| 7,651,421 | B2 | 1/2010 | Smith et al. | |
| 7,686,714 | B2 | 3/2010 | Smith et al. | |
| 8,057,330 | B2 * | 11/2011 | Blosser | F42B 6/04 473/582 |
| 8,460,134 | B2 * | 6/2013 | Palomaki | F42B 6/08 473/582 |
| 8,475,303 | B2 | 7/2013 | James | |
| 8,480,520 | B2 * | 7/2013 | Webber | F24B 6/08 473/582 |
| 8,668,605 | B1 * | 3/2014 | Huang | F24B 6/08 473/582 |
| 8,784,243 | B2 * | 7/2014 | James | F42B 6/04 473/578 |
| 8,961,341 | B2 * | 2/2015 | Dickerson | F42B 6/08 473/582 |
| 2009/0163308 | A1 * | 6/2009 | Odabachian | F42B 6/08 473/582 |
| 2013/0288831 | A1 | 10/2013 | James | |

* cited by examiner

*Primary Examiner* — John Ricci
(74) *Attorney, Agent, or Firm* — Gary L. Eastman, Esq.

(57) ABSTRACT

The Adjustable Archery Arrow Insert is a three-piece arrow tip attached to an arrow shaft and includes an arrow tip insert, an arrow tip collar, and an arrow tip. The arrow tip insert is threadably received by the arrow tip collar and is attached to the arrow shaft, where the arrow tip is inserted within, and the arrow tip collar overlaps, the arrow shaft. The arrow tip is inserted through the arrow tip collar and attached directly to the arrow tip insert without protruding into the arrow shaft. Sections of the arrow tip insert may be removed to adjust the overall weight of the arrow. The Adjustable Archery Arrow Insert transfers the impact forces of the arrow tip to the arrow tip insert and arrow tip collar, where the forces are transferred over a larger area thereby minimizing the forces on front edge of the arrow shaft.

15 Claims, 6 Drawing Sheets

ADJUSTABLE ARCHERY ARROW INSERT

RELATED APPLICATION

This application claims the benefit of, and priority to, U.S. Provisional Patent Application No. 62/024,413 entitled "Adjustable Archery Arrow Insert" filed on Jul. 14, 2014.

FIELD OF INVENTION

The present invention relates generally to archery. The present invention is more particularly, though not exclusively, related to arrow tip inserts utilized to removably attached arrow tips to an arrow shaft.

BACKGROUND OF THE INVENTION

An arrow includes an arrow shaft having a tip, a nock, and fletching. Traditionally, arrow tips are mounted directly to the arrow shaft. Arrow tips have a point with a protruding stud, where the stud is inserted and fixedly attached within the arrow shaft as the point rests on the front edge of the arrow shaft. There are several disadvantages to these traditional arrow tips and their method of attachment. A particular disadvantage of directly mounting the arrow tips to the arrow shafts is that they are typically permanently affixed to the arrow shafts. This inhibits the user from changing between different tips for use on the arrow shaft. Additionally, if the arrow shaft breaks the tip would not be able to be reused with an alternative arrow shaft. Another disadvantage is that the arrow tip delivers a majority of the impact forces to the front edge of the arrow shaft thereby damaging it. Particularly in carbon fiber arrow shafts, the forces of the tip on the arrow shaft eventually degrades the epoxy resulting in the fraying of the individual carbon fibers. In order to overcome these disadvantages, arrow tip inserts have been created with varying results.

Arrow tip inserts have been created to overcome the disadvantages of directly mounting an arrow tip to the arrow shaft. Arrow tip inserts typically have a body formed with a bore to receive an arrow tip. The body is further formed with a protruding stud to mount the arrow tip insert to the arrow shaft. The bore can be further formed with threads to threadably receive arrow tips. This enables a user to switch arrow tips by unthreading the tip from the insert. Alternative arrow tip inserts are further formed with a circumferential groove on the body adjacent the stud to accept the arrow shaft walls, thereby forming a collar around the arrow shaft walls. The arrow tip stud is inserted into the arrow shaft and the front-edge of the arrow shaft contacts the insert. This arrangement enhances the strength of the connection between the arrow tip insert and the arrow shaft by having the tip of the arrow shaft inserted within the circumferential groove and overlapped by the collar. However, in both cases, the majority of the impact is still absorbed by the front edge of the arrow shaft thereby leading to eventual failure of the front edge arrow of the shaft after periods of use.

An alternative arrow tip insert has been created with the aim to overcome the disadvantages of the arrow tip insert as mentioned above. In this particular prior art embodiment, the arrow tip insert is a cylindrical rod having an internal threaded bore at one end and circumferential grooves formed on the exterior of the cylindrical rod adjacent the opposite end. The cylindrical rod is dimensioned to be fully inserted and enclosed within the arrow shaft and fixedly attached. The arrow tip having a point formed with a stud, the stud having a threaded portion, is threadably received by the internal threaded bore of the arrow tip insert. As the arrow tip is threaded onto the arrow tip insert, the stud contacts the side walls and the point contacts the front edge of the arrow shaft. Although the arrow tip is removable, the majority of the impact forces from the arrow tip remains concentrated on the front edge of the arrow shaft. Although the disadvantages of the traditional arrow tip and arrow shaft have been addressed by the prior art, the prior art has failed to create a solution to overcome ail of the disadvantages.

In light of the above, it would be advantageous to provide an arrow with an arrow tip, arrow tip insert, and arrow tip collar having the ability to dampen the impact of the arrow tip to the front edge of the arrow shaft. It would further be advantageous to provide an arrow by with the ability to be removably attached to an arrow shaft. It would further be advantageous to provide an arrow by removably attached to an arrow shaft in which the arrow tip does not protrude within the bore of the arrow shaft, completely removing the arrow by from being inserted into the bore of the arrow shaft.

SUMMARY OF THE INVENTION

The Adjustable Archery Arrow insert is utilized on an arrow having an arrow tip to transfer the impact forces experienced by the arrow tip to the Adjustable Archery Arrow Insert, wherein the Adjustable Archery Arrow Insert transfers the force over a larger area thereby dampening the force experienced by the front edge of the arrow shaft. The Adjustable Archery Arrow Insert includes a three piece arrow by having an arrow tip insert, an arrow tip collar, and an arrow tip. The arrow tip insert is fixedly attached to the arrow shaft bore by the use of adhesives. The arrow by collar is mechanically coupled to the arrow tip insert. The arrow tip is fitted within the collar and attached directly to the arrow tip insert, wherein the forces experienced by the arrow tip are absorbed by the arrow tip insert and dispersed to the collar and the arrow shaft. Furthermore, the arrow tip is located completely outside of the arrow shaft and does not protrude within the arrow shaft bore.

The weight of the Adjustable Archery Arrow Insert is adjustable to meet the specifications desired of an arrow. The arrow by insert is constructed with a plurality of circumferential grooves spaced evenly apart. The section defined between each circumferential groove has a predetermined weight and may be removed from the arrow tip insert to control the weight of the arrow tip insert and the overall weight of the Adjustable Archery Arrow Shaft. Furthermore, the three pieces of the Archery Arrow Shaft Insert are interchangeable with alternative versions of the three pieces of the Archery Arrow Shaft Insert which may be constructed lighter or heavier. This allows another degree of weight adjustability.

The Adjustable Archery Arrow Insert of the present invention provides an arrow tip attached directly to an arrow tip insert which removes and locates the arrow tip outside of the arrow shaft, eliminating direct contact of the arrow tip with the front edge and walls of the arrow shaft. This allows the arrow tip to transfer all the impact forces to the arrow tip insert which subsequently transfers the forces to the collar and arrow shaft, minimizing the amount of force absorbed by the front edge of the arrow shaft.

BRIEF DESCRIPTION OF THE FIGURES

The nature, objects, and advantages of the present invention will become more apparent to those skilled in the art after considering the following detailed description in connection with the accompanying drawings, in which like reference numerals designate like parts throughout, and wherein.

DETAILED DESCRIPTION OF THE INVENTION

Figure 1:
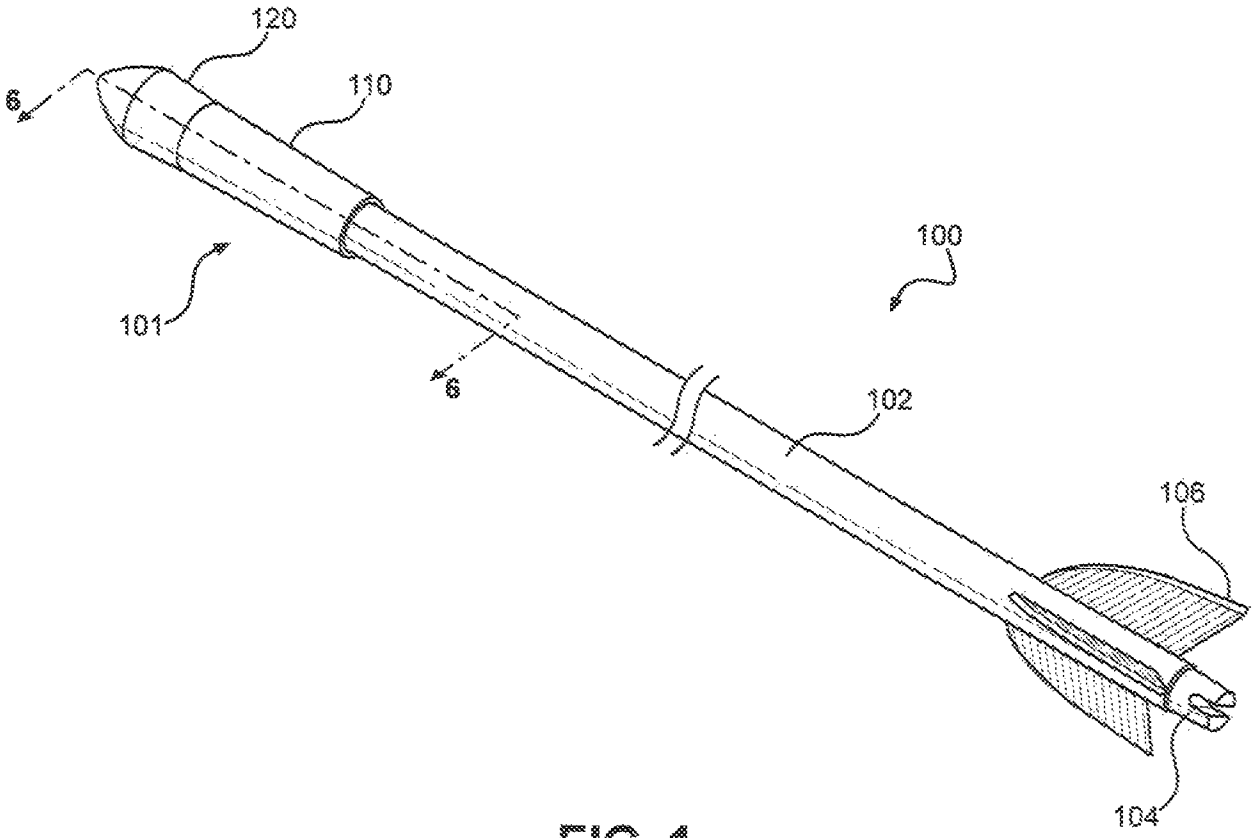
FIG. 1 is a side view of an Adjustable Archery Arrow Insert of the present invention attached to an arrow shaft.

Referring initially to FIG. 1, a perspective view of an arrow having an Adjustable Archery Arrow Insert 101 attached is shown and generally designated 100. The arrow 100 includes an arrow shaft 102 with a front end and a tail end. At the tail end of arrow shaft 102, a nock 104 is attached. Adjacent the nock 104 and attached to the exterior of the arrow shaft 102 is fletching 106. Attached to the front end of the arrow shaft 102 is the Adjustable Archery Arrow Insert 101 of the present invention, which includes an arrow tip collar 110, an arrow tip 120 and arrow tip insert 130 (shown in FIG. 2). Arrow by insert 130 is fixedly attached to the arrow shaft 102. An arrow tip collar 110 is threadably attached to the arrow tip insert 130. An arrow tip 120 is threadably attached to the arrow tip insert 130 and contacts the front edge of the arrow tip collar 110.

Figure 2:
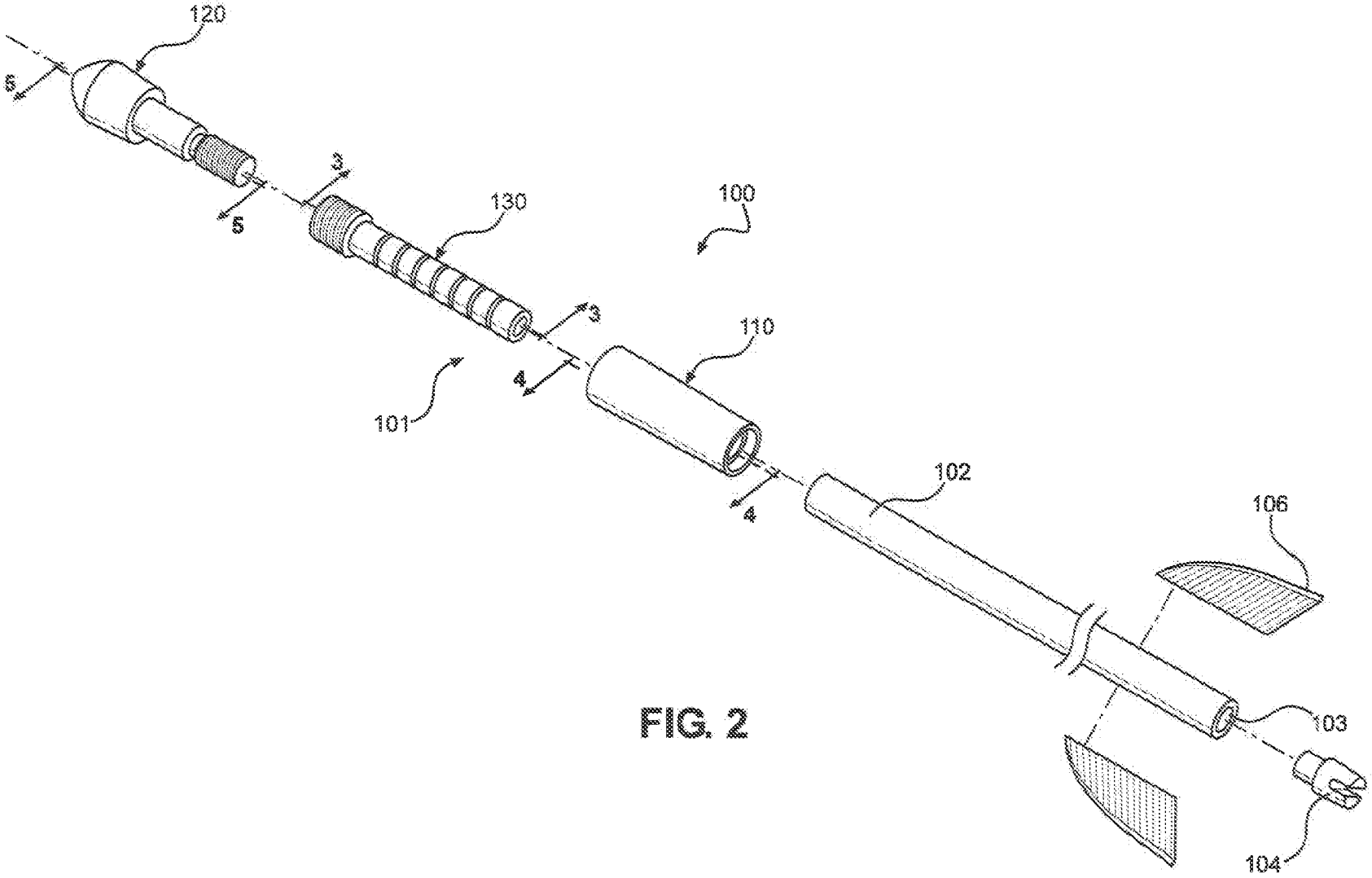
FIG. 2 is an exploded view of the Adjustable Archery Arrow Insert of the present invention, having an arrow tip, an arrow tip collar, and an arrow tip insert, attached to an arrow shaft having a nock and fletching.

Referring now to FIG. 2, an exploded view of the arrow 100 is shown. The arrow shaft 102 is formed with an internal bore 103. Inserted into the arrow shaft 102 at the tail end is the nock 104 and attached on the exterior of the arrow shaft 102, adjacent to nock 104, is fletching 106. Attached to the front end of the arrow shaft 102 is the arrow tip collar 110, the arrow by 120 and the arrow tip insert 130 of the Adjustable Archery Arrow Insert 101.

The arrow by 120 is removably attached to the arrow by insert 130 through the use of threads, allowing the removal of arrow by 120 from the arrow tip insert 130. However, it is contemplated that the use of a friction fit or adhesive may be used for a permanent attachment. The assembled arrow tip 120 and arrow tip insert 130 is slid through the arrow by collar 110 whereby the arrow tip insert 130 is threaded into the arrow tip collar 110. The arrow by insert 130 is then inserted into the internal bore 103 of the arrow shaft 102 and fixedly attached. Alternatively, before attaching the arrow tip 120 to the arrow tip insert 130, the arrow tip insert 130 may be slid through the arrow by collar 110 whereby the arrow tip insert 130 is threaded into the arrow tip collar 110. The arrow tip insert 130 is then inserted into the internal bore 103 of the arrow shaft 102 and fixedly attached. Subsequently, the arrow by 120 may then be removably attached to the arrow tip insert 130 through the use of threads, allowing the removal of arrow tip 120 from the arrow tip insert 130 in circumstances where it is desirous to switch the arrow by 120 to an alternative arrow tip 120.

Figure 3:
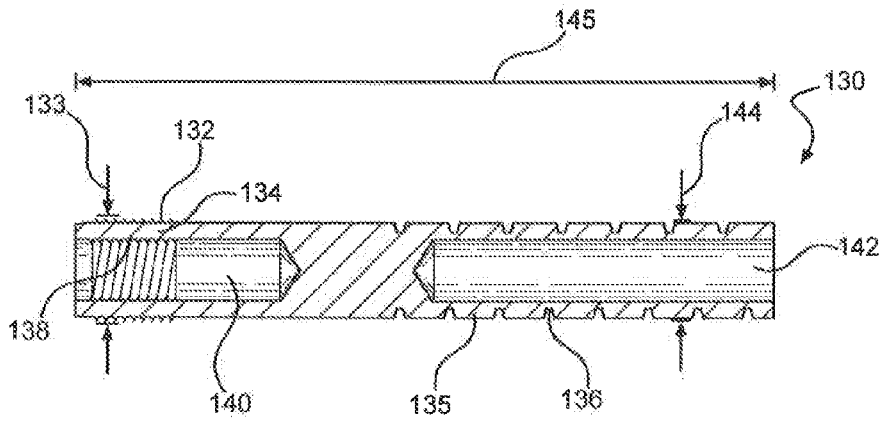
FIG. 3 is a cross-sectional view of the arrow tip insert of the present invention showing the arrow tip insert having a threaded bore to threadably receive the arrow by and having external threads to be threadably inserted into arrow tip collar.

Referring now to FIG. 3, a cross-section of the arrow tip insert 130 taken along line 3-3 of FIG. 2 is shown. The arrow tip insert 130 includes a stud head 134 having external diameter 133 with a cylindrical stud 135 having a smaller diameter 144 extending therefrom. The stud head 134 is formed with an internal bore 140 with internal threads 138. The exterior of the stud head 134 is formed with external threads 132. Diameter 144 of the cylindrical stud 135 has a uniform diameter slightly smaller than the bore 103 of the arrow shaft 102 to allow the cylindrical stud 135 to be inserted into the bore 103 of arrow shaft 102. The cylindrical stud 135 is further formed with a series of circumferential grooves 136 and an interior bore 142 to decrease overall weight. The circumferential grooves 136 also provide additional surface area for adhesives to adhere. The length 145 of cylindrical stud 135 and the uniform diameter 144 allows the proper alignment of the central axis of the cylindrical stud 135 and the arrow shaft 102 to ensure arrow 100 is straight and true.

Further, the weight of the arrow tip insert 130 may be adjusted by breaking off portions of the cylindrical stud 135 at each circumferential groove 136 upon the application of a predetermined force. Each section of the cylindrical stud 135 between two circumferential grooves 136 are predetermined to have a certain weight, for example each section may weigh between 1.0 grain and 3.0 grains. This allows the precise weight control of the arrow tip insert 130 by removing as much or as little of the cylindrical stud 135 as desired. Additionally, the interior bore 142 may be filled with a material to add additional weight to the arrow tip insert 130. By varying the weight of the arrow tip insert 130, a user may adjust the weight of the Adjustable Archery Arrow Insert 101 and ultimately the arrow 100. Additionally, the adhesive used to attach the arrow tip insert 130 to the arrow shaft 102 allows the insert 130 to be removed thus allowing the arrow tip insert 130 to be interchangeable for an alternative arrow tip insert 130 having a different weight, allowing the Adjustable Archery Arrow Insert 101 an additional degree of weight adjustability.

Figure 4:
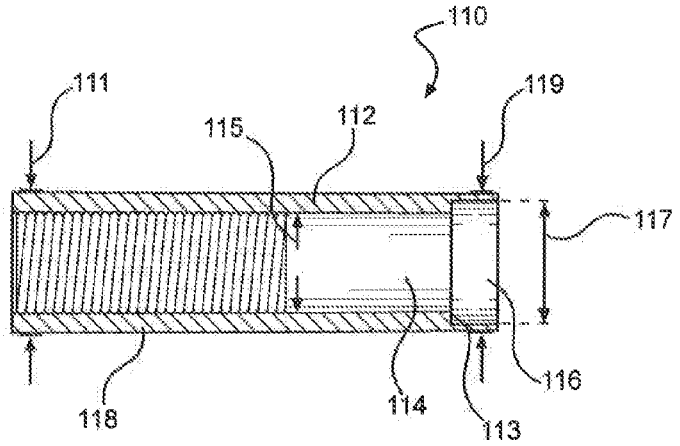
FIG. 4 is a cross-sectional view of the arrow tip collar of the present invention showing the arrow by collar having an internal threaded bore formed to threadably receive the arrow by insert and formed with a secondary bore to receive the arrow shaft.

Referring now to FIG. 4, a cross-section of the arrow tip collar 110 taken along line 4-4 of FIG. 2 is shown. The arrow tip collar 110 has a tapered body 112 tapering from a first diameter 111 to a second diameter 119. The tapered body 112 is further formed with a first internal bore 114 having a diameter 115 which terminates at a second internal bore 116 having a larger diameter 117 than the diameter 115 of first internal bore 114, creating a transition ledge 113 extending from the first internal bore 114 to the second internal bore 116. Diameter 117 is slight larger than the exterior diameter of the arrow shaft 102. This allows the arrow shaft 102 to be precisely fitted within the second internal bore 116 of the arrow tip collar 110. The first and second internal bore, 114 and 116 respectively, extend all the way through the tapered body 112. Extending part way through the axial length of first bore 114 is a series of threads 118 corresponding to the external threads 132 of the arrow tip insert 130, allowing the arrow tip collar 110 to threadably receive arrow tip insert 130.

Figure 5:
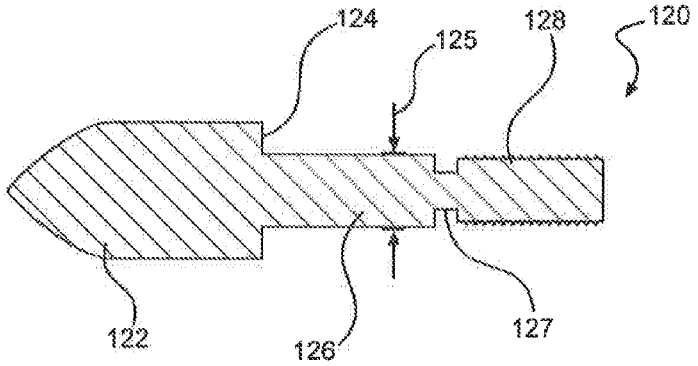
FIG. 5 is a cross-sectional view of the arrow tip of the present invention showing the arrow tip having a threaded stud to be threadably insert into the arrow tip insert.

Referring now to FIG. 5, a cross-section of the arrow tip 120 taken along line 5-5 of FIG. 2 is shown. The arrow tip 120 has a point 122 with a base 124. Extending from the base 124 is a cylindrical stud 126 having diameter 125 and formed with a circumferential groove 127. Further formed on the cylindrical stud 126, adjacent the circumferential groove 127 on the opposite end of the point 122, are threads 128 corresponding to the internal threads 138 of the arrow insert 130. The first internal bore 114 of the collar 110 is dimensioned larger than the cylindrical stud 126 creating a slight clearance between the two parts and prevents the cylindrical stud 126 from damaging the threads 118 of the collar 110, where the diameter 115 is larger than diameter 125.

Figure 6:
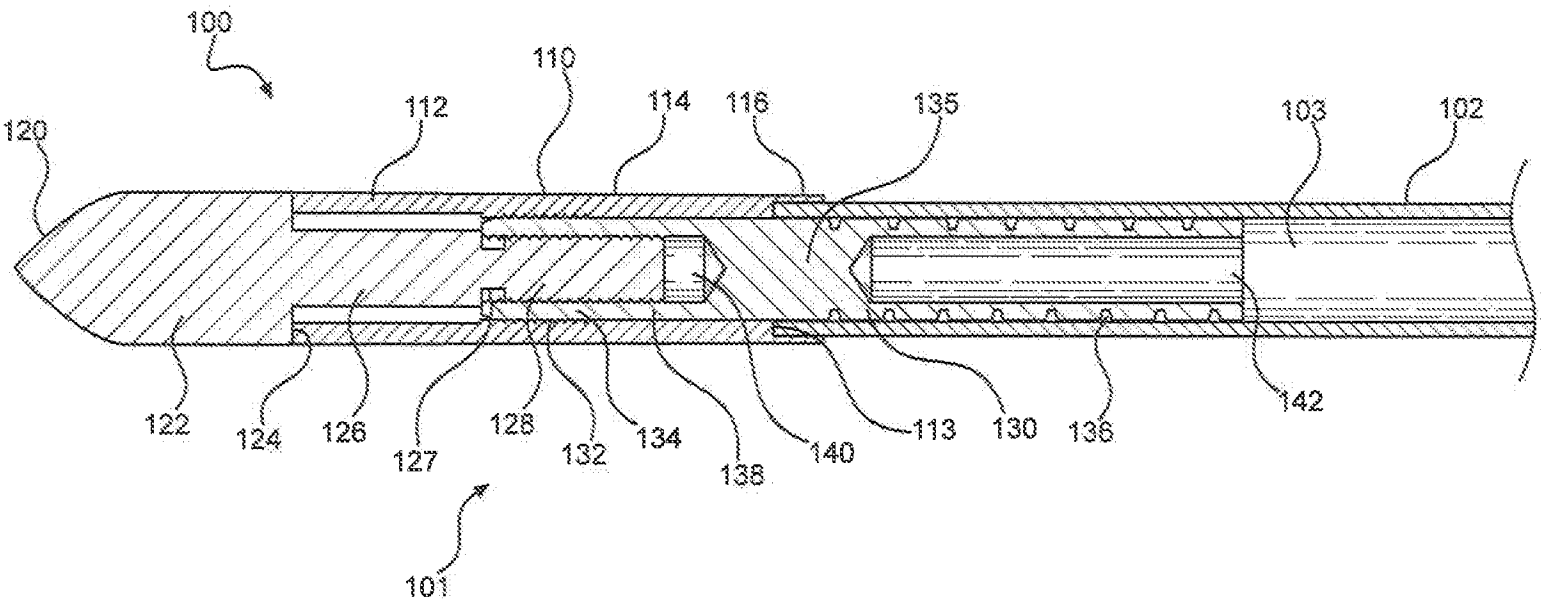
FIG. 6 is a cross section view of the Adjustable Archery Arrow Insert of the present invention showing the arrow tip attached to the arrow tip insert which is inserted into the arrow shaft, where the arrow tip does not protrude within the arrow shaft bore.

Referring now to FIG. 6, a cross-section of arrow 100 taken along line 6-6 of FIG. 1 is shown. As shown, arrow tip insert 130 is the only component inserted into the internal bore 103 of the arrow shaft 102. The arrow tip collar 110 contacts only the exterior front edge of the arrow shaft 102. The arrow tip 120 comes into contact with only the collar 110 and the arrow tip insert 130. Further, the arrow tip 120 is located completely outside of the arrow shaft 102.

The arrow tip 120 is threadably attached to the arrow tip insert 130 through the use of threads, allowing the tip 120 to be removed from the arrow tip insert 130 and collar 120. The external threads 128 of the arrow tip 120 is threadably received by the internal threads 138 of the arrow tip insert 130 forming an arrow tip with an elongated insert. The mechanically coupled arrow tip 120 and arrow tip insert 130 is slid through the collar 110 where the external threads 132 of the arrow tip insert 130 is threadably received by the internal threads 118 of the collar 110. The cylindrical stud 135 of arrow tip insert 120 is inserted into the internal bore 103 of the arrow shaft 102 and fixedly attached by the use of adhesives. It is contemplated that other methods of attachment may be used. The arrow shaft 102 is inserted within an annular channel 117 created by the second bore 116 of the collar 110 and the cylindrical stud 135, confining the arrow shaft 102 between the body 112 of collar 110 and the cylindrical stud 135 of the arrow tip insert 130. Further, the front edge of the arrow shaft 102 comes into contact with the ledge 113.

Alternatively, before attaching the arrow tip 120 to the arrow tip insert 130, the arrow tip insert 130 may be slid through the arrow tip collar 110 whereby the arrow tip insert 130 is threaded into the arrow tip collar 110. The external threads 132 of the arrow tip insert 130 is threadably received by the internal threads 118 of the collar 110. The cylindrical stud 135 of arrow tip insert 120 is inserted into the internal bore 103 of the arrow shaft 102 and fixedly attached by the use of adhesives. The arrow shaft 102 is inserted within the gap created by the second bore 116 of the collar 110, confining the arrow shaft 102 between the body 112 of collar 110 and the cylindrical stud 135 of the arrow tip insert 130. The arrow tip 120 may then be removably attached to the arrow tip insert 130. The external threads 128 of the arrow tip 120 is threadably received by the internal threads 138 of the arrow tip insert 130, allowing the removal of arrow tip 120 from the arrow tip insert 130 in circumstances where it is desirous to switch the arrow tip 120 to an alternative arrow tip 120.

Due to the fact that the arrow tip 110 is mechanically coupled to the arrow tip insert 130 and not to the arrow tip collar 110, the axial forces experienced by the arrow by 120 is transferred to the arrow tip insert 130 which is transferred to arrow shaft 102 as a shear force. The arrow tip insert 130 also transfers force to the collar 110 which transfers the force to the front edge of the arrow shaft 102 as a compressive force. The anchored surface between the cylindrical stud 135 and the arrow shaft 102 provides a large surface area in which the shear force is distributed. This allows the distribution of the axial force from the arrow tip 120 as shear forces to a larger area, minimizing the force absorbed by any one particular point. By dispersing the force of impact across a larger area, the front-edge impact is minimized. The collar 110 also provides lateral support for the arrow tip 110.

In an alternative embodiment, the arrow tip collar 110 is further elongated to allow the formation of an elongated secondary bore 116, the secondary bore 116 having uniform diameter 117 sized to closely fit around the exterior of the arrow shaft 102. This allows the arrow tip collar 110 to enclose a larger portion of the arrow shaft 102. In the alternative embodiment, the cylindrical stud 135 of arrow tip insert 130 is formed with a taper tapering from a larger diameter adjacent the stud head 132 to the smaller diameter 144 at the opposite end. The taper angle of the cylindrical stud 135 is minimal allowing the arrow tip insert 130 to be inserted into the arrow shaft bore 103 a predetermined distance before the taper of the cylindrical stud 135 creates an interference fit with the arrow shaft 103.

The complete insertion of the arrow tip insert 130 with the cylindrical stud 135 having the taper is designed to slightly expand the arrow shaft 102. However, because the arrow tip collar 110 is placed over the arrow shaft 102, the arrow shaft 102 does not expand to the point where the physical integrity of the arrow shaft 102 is compromised. The arrow tip collar 110 maintains the size of the arrow shaft 102 within ideal tolerances to maintain its structural integrity. However, slight expansion of the arrow shaft 102 due to the arrow tip insert 130 compresses the arrow shaft was 102 between the secondary bore 116 of the arrow tip collar 110 and the exterior of the cylindrical stud 135, anchoring the assembly onto the arrow shaft 102.

The arrow tip 120 is threadably received by the arrow tip insert 130, with the base 124 contacting the front edge of the arrow tip collar body 112. Due to the fact that the arrow tip 110 is mechanically coupled to the arrow tip insert 130 and not to the arrow tip collar 110, the axial forces experienced by the arrow tip 120 is transferred to the arrow tip insert 130 which is then transferred to arrow shaft 102 as a shear force. The arrow tip insert 130 transfers minimal forces to the collar 110 which transfers the force to the front edge of the arrow shaft 102 as a compressive force. The anchored surface between the cylindrical stud 135 and the arrow shaft 102 provides a large surface area in which the shear force is distributed. This allows the distribution of the axial force from the arrow tip 120 as shear forces to a larger area, minimizing the force absorbed by any one particular point. By dispersing the force of impact across a larger area, the front-edge impact is minimized. The collar 110 also provides lateral support for the arrow tip 110.

Figure 7:
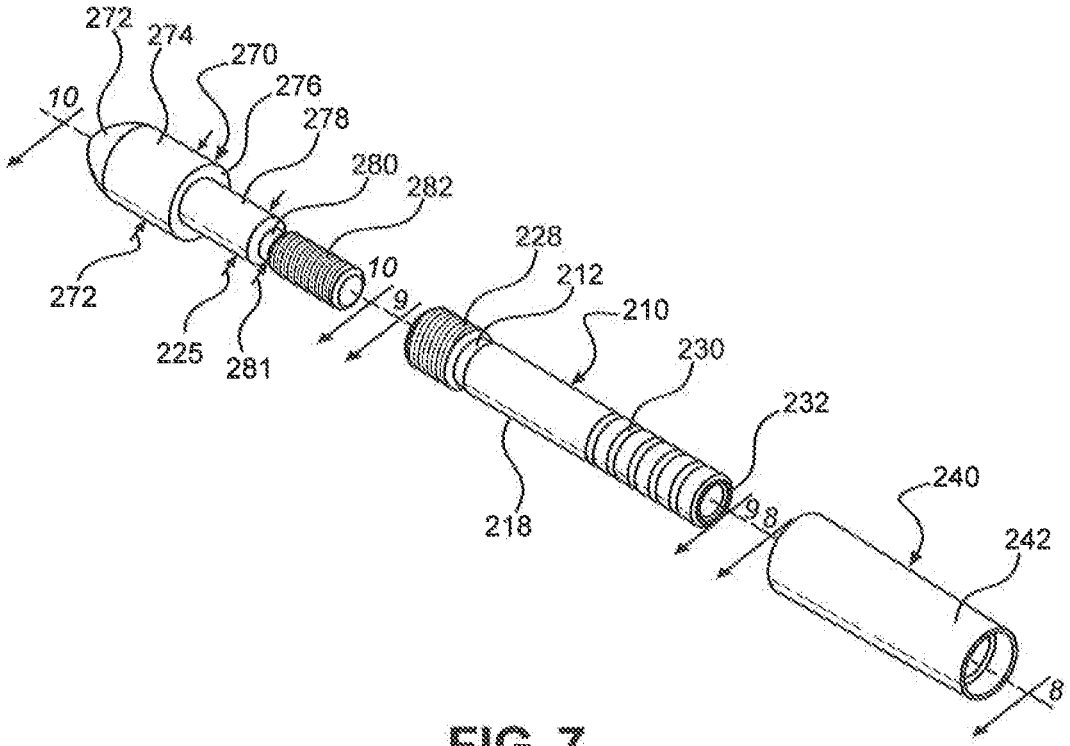
FIG. 7 is an exploded view of an alternative embodiment of the Adjustable Archery Arrow Insert having an arrow tip, an arrow by collar, and an arrow by insert.

Referring now to FIG. 7, an exploded perspective view of an alternative embodiment of the Adjustable Archery Arrow Insert of the present invention is shown and generally designated 201. The Adjustable Archery Arrow Insert 201 includes an arrow tip insert 210, an arrow tip collar 240 and an arrow tip 270.

Figure 8:
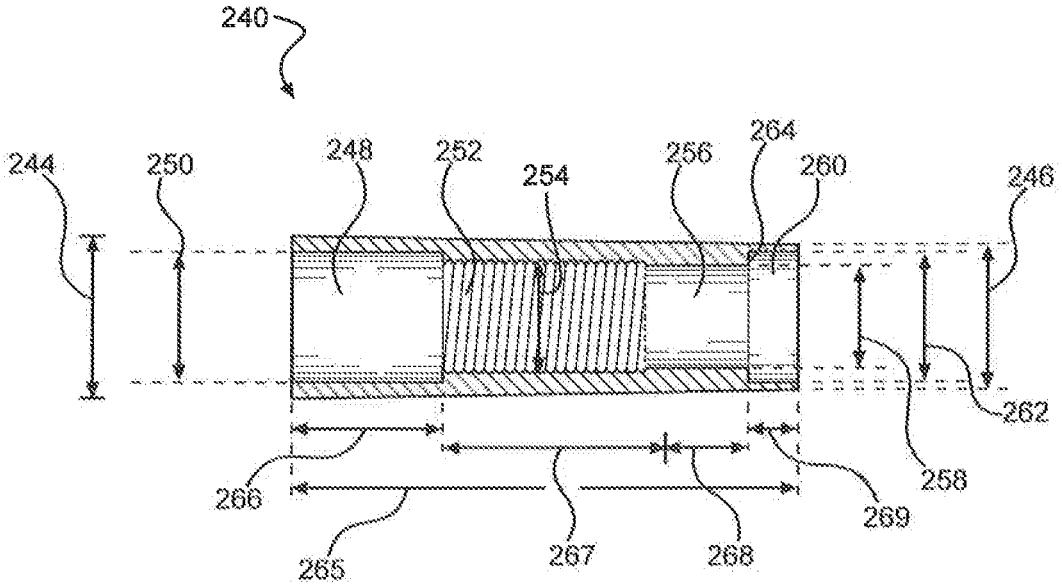
FIG. 8 is a cross-sectional view of the arrow tip collar of the alternative embodiment of the Adjustable Arrow Shaft Insert of the present invention.

The arrow tip insert 210, described in conjunction with FIG. 8, a cross-sectional view of the arrow tip insert 210 taken along line 9-9 of FIG. 7, includes a stud head 212 having external diameter 214 and length 216 with a cylindrical stud 218 having a smaller uniform diameter 220 extending therefrom. The arrow tip insert 210 has an overall length 222. The stud head 212 is formed with a threaded bore 224 with diameter 226. The exterior of the stud head 212 is formed with external threads 228. Diameter 214 of the cylindrical stud 218 has a uniform diameter 220 slightly smaller than the bore 103 of the arrow shaft 102 to allow the cylindrical stud 218 to be inserted into the bore 103 of arrow shaft 102. The cylindrical stud 218 has a length 236 and is further formed with a series of circumferential grooves 230 and an interior bore 232 having bore diameter 234 connected to threaded bore 224 to decrease overall weight. Alternatively, the interior bore 232 may be filled with a material to increase overall weight. The circumferential grooves 230 also provide additional surface area for adhesives to adhere. The length 236 of cylindrical stud 235 and the uniform diameter 220 allows the proper alignment of the cylindrical stud 218 and the arrow shaft 102 to ensure arrow 100 is straight and true.

Further, the weight of the arrow tip insert 210 may be adjusted by breaking off portions of the cylindrical stud 118 at each circumferential groove 230 upon the application of a predetermined force. Each section of the cylindrical stud 218 between two circumferential grooves 230 are predetermined to have a certain weight. This allows the precise weight control of the arrow tip insert 130 by removing as much or as lithe of the cylindrical stud 118 as desired. By varying the weight of the arrow tip insert 210, a user may adjust the weight of the Adjustable Archery Arrow insert 201 and ultimately the arrow 100. Additionally, the adhesive used to attach the arrow tip insert 210 to the arrow shaft 102 allows the arrow tip insert 210 to be removed thus allowing the arrow tip insert 210 to be interchangeable for an alternative arrow tip insert 210 having a different weight, allowing the Adjustable Archery Arrow Insert 201 an additional degree of weight adjustability.

Figure 9:
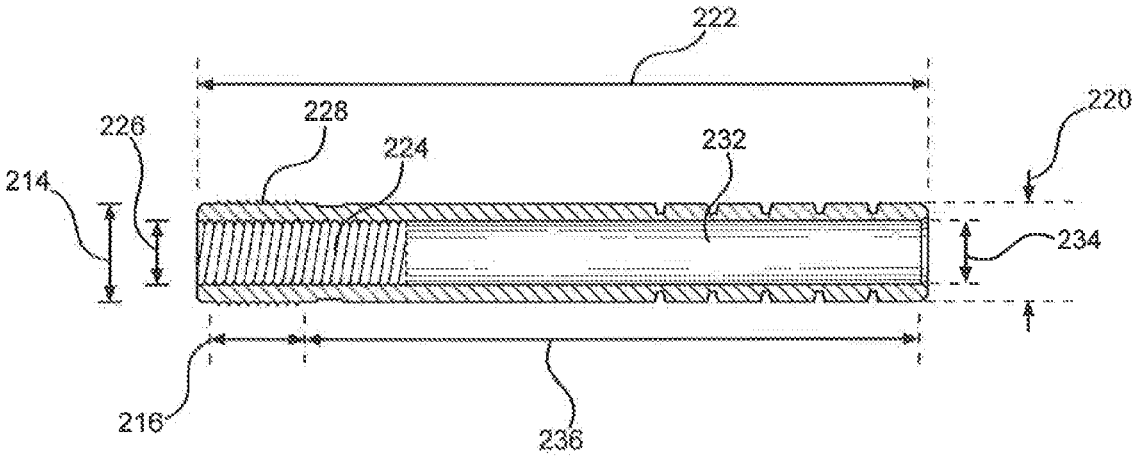
FIG. 9 is a cross-sectional view of the arrow tip insert of the alternative embodiment of the Adjustable Arrow Shaft Insert of the present invention.

The arrow by collar 240, described in conjunction with FIG. 9, a cross-section of the arrow tip collar 240 taken along line 8-8 of FIG. 7, has a tapered body 242 tapering from a first diameter 244 to a second diameter 246. The tapered body 242 is further formed with a first internal bore 248 having a diameter 250 which terminates at a threaded bore 252 having a thread diameter 254. The threaded bore 252 then terminates at a second internal bore 256 having a smaller diameter 258 than the thread diameter 254. The second internal bore 256 then terminates at a third internal bore 260 having a bore diameter 262 which is greater than second internal bore 256, creating a transition ledge 264 extending from the second internal bore 256 to the third internal bore 260. Diameter 262 is slight larger than the exterior diameter of the arrow shaft 102. This allows the arrow shaft 102 to be precisely fitted within the third internal bore 262 of the arrow tip collar 240. The first internal bore 248, the threaded bore 252, second internal bore 256, and third internal bore 260, extend all the way through the tapered body 242.

The arrow by collar 240 has an overall length 265. The first internal bore 248 extends a length 266, the threaded bore 252 extends a length 267, the second internal bore 256 extends a length 268, and the third internal bore 260 extends a length 269 through the arrow tip collar 240. The threaded bore 252 corresponds to the external threads 228 of the arrow tip insert 210, allowing the arrow by collar 240 to threadably receive arrow by insert 210. The diameter 250 of the first internal bore 248 allows the arrow by insert 210 to pass without obstruction to the threaded bore 252.

The arrow by 270 has a point 272 with a base 274 with diameter 275. Extending from the base 274 is a cylindrical stud 278 having diameter 225 and formed with a circumferential groove 280 with diameter 281. Diameter 279 of cylindrical stud 278 is smaller than diameter 275 of base 274 thereby creating a shoulder 276 between the transition from the base 274 to the cylindrical stud 278. Further formed on the cylindrical stud 278, adjacent the circumferential groove 280 opposite point 272, are threads 282 corresponding to the internal threads 226 of the arrow shaft insert 210. The first internal bore 248 and threaded bore 252 of the collar 240 is dimensioned larger than the cylindrical stud 278 creating a slight clearance between the parts and prevents the cylindrical stud 278 from damaging the threads of threaded bore 252 of the collar 210, where the diameters 250 and 254 is larger than diameter 225.

Figure 10:
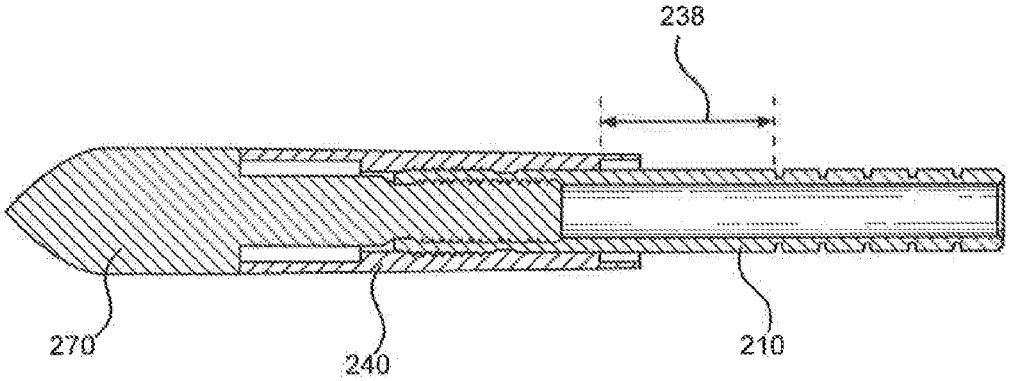
FIG. 10 is a cross-sectional view of the Adjustable Arrow Shaft Insert of the present invention.

Referring now to FIG. 10, a cross-sectional view of the Adjustable Arrow Shaft Insert 201 is shown. As shown, arrow by insert 210 would be the only component inserted into the internal bore 103 of the arrow shaft 102. The arrow tip insert 210 has a minimum length 238 which will always be attached to the arrow shaft 102. This ensures adequate adhesions between the arrow tip insert 210 and the arrow shaft 102. The arrow tip collar 210 is configured to contact only the exterior front edge of the arrow shaft 102. The arrow tip 270 contacts only the collar 240 and the arrow tip insert 210. The arrow tip 270 is located completely outside of the arrow shaft 102 when the Adjustable Arrow Shaft Insert 201 is attached to the arrow shaft 102.

The arrow tip 270 is threadably attached to the arrow tip insert 210 through the use of threads, allowing the tip 270 to be removed from the arrow tip insert 210 and collar 240. The external threads 282 of the arrow tip 270 is threadably received by the threaded bore 226 of the arrow tip insert 210 forming an arrow tip with an elongated insert. The mechanically coupled arrow tip 270 and arrow tip insert 210 is slid through the collar 240 where the external threads 228 of the arrow tip insert 210 is threadably received by the threaded bore 252 of the collar 240. The cylindrical stud 218 of arrow tip insert 210 is inserted into the internal bore 103 of the arrow shaft 102 and fixedly attached by the use of adhesives. The arrow shaft 102 is inserted within an annular channel 265 (not shown) created by the third internal bore 260 of the collar 240 and the cylindrical stud 218, confining the arrow shaft 102 between the body 242 of collar 240 and the cylindrical stud 218 of the arrow tip insert 210. Further, the front edge of the arrow shaft 102 comes into contact with the ledge 264.

Alternatively, before attaching the arrow tip 270 to the arrow tip insert 210, the arrow tip insert 210 may be slid through the arrow tip collar 240 whereby the arrow tip insert 210 is threaded into the arrow tip collar 240. The external threads 228 of the arrow by insert 210 is threadably received by the thread bore 252 of the collar 240. The cylindrical stud 218 of arrow tip insert 210 is inserted into the internal bore 103 of the arrow shaft 102 and fixedly attached by the use of adhesives. The arrow shaft 102 is inserted within the gap created by the third internal bore 260 of the collar 240, confining the arrow shaft 102 between the body 242 of collar 240 and the cylindrical stud 218 of the arrow tip insert 210. Further, the front edge of the arrow shaft 102 comes into contact with the ledge 264. The arrow tip 270 may then be removably attached to the arrow tip insert 210. The external threads 282 of the arrow tip 270 is threadably received by the threaded bore 226 of the arrow tip insert 210, allowing the removal of arrow tip 270 from the arrow tip insert 210 in circumstances where it is desirous to switch the arrow tip 270 to an alternative arrow tip 270.

While there have been shown what are presently considered to be preferred embodiments of the present invention, it will be apparent to those skilled in the art that various changes and modifications can be made herein without departing from the scope and spirit of the invention.

I claim:

1. An Adjustable Archery Arrow Insert comprising:

an arrow tip collar;

an arrow tip insert threadably inserted into said arrow tip collar; and an arrow tip inserted through said arrow tip collar and threadably received by said arrow tip insert.

2. The Adjustable Archery Arrow Insert of claim 1, wherein said arrow tip collar comprises:

a tapered body tapering from a first diameter to a second diameter, said taper body formed with a first internal bore having a first diameter and a second internal bore having a second diameter larger than said first diameter, said first internal bore formed with internal threads.

3. The Adjustable Archery Arrow Insert of claim 1, wherein said arrow tip insert comprises:

a stud head having a cylindrical shape, said stud head formed with external threads corresponding to said internal threads of said arrow tip collar;

a cylindrical stud protruding from said stud head and formed with a plurality of circumferential grooves, wherein said circumferential grooves are dimensioned to allow said cylindrical stud to be broken off at said circumferential grooves upon the application of a predetermined force to adjust the weight of said arrow tip insert;

a first internal bore formed into said stud head and formed with internal threads; and a second internal bore formed into said cylindrical stud.

4. The Adjustable Archery Arrow Insert of claim 3, wherein said cylindrical stud further comprises a plurality of weighted sections, wherein each of said plurality of weighted sections is defined as the portion of said cylindrical stud between two of each said plurality of circumferential grooves, each of said plurality of weighted sections having a predetermined weight.

5. The Adjustable Archery Arrow Insert of claim 4, wherein said predetermined weight of said each of said plurality of weighted sections is between 1.00 grain and 3.00 grains.

6. The Adjustable Archery Arrow Insert of claim 1, wherein said arrow tip comprises:

a base;

a tip formed into said base; and a cylindrical stud formed into said base opposite said tip, said cylindrical stud formed with external threads corresponding to said internal threads of said arrow tip insert.

7. The Adjustable Archery Arrow Insert of claim 1, wherein said arrow tip insert threaded to said arrow tip collar forms an annular channel between said arrow tip insert and said arrow tip collar.

8. An arrow with an Adjustable Archery Arrow Insert comprising:

an arrow shaft having a point end and a nock end;

an Adjustable Archery Arrow Insert attached to said point end of said arrow shaft, said Adjustable Archery Arrow Insert comprises an arrow tip collar, an arrow tip insert threadably inserting into said arrow tip collar, and an arrow tip inserted through said arrow tip collar and threadably received by said arrow tip insert;

a nock attached to said nock end of said arrow shaft; and a plurality of fletching attached to said arrow shaft adjacent said nock end.

9. The Adjustable Archery Arrow Insert of claim 8, wherein said arrow tip collar comprises:

a tapered body tapering from a first diameter to a second diameter, said taper body formed with a first internal bore having a first diameter and a second internal bore having a second diameter larger than said first diameter, said first internal bore formed with internal threads.

10. The Adjustable Archery Arrow Insert of claim 8, wherein said arrow tip insert comprises:

a stud head having a cylindrical shape, said stud head formed with external threads corresponding to said internal threads of said arrow tip collar;

a cylindrical stud protruding from said stud head and formed with a plurality of circumferential grooves, wherein said circumferential grooves are dimensioned to allow said cylindrical stud to be broken off at said circumferential grooves upon the application of a predetermined force to adjust the weight of said arrow tip insert;

a first internal bore formed into said stud head and formed with internal threads; and a second internal bore formed into said cylindrical stud.

11. The Adjustable Archery Arrow Insert of claim 10, wherein said cylindrical stud further comprises a plurality of weighted sections, wherein each of said plurality of weighted sections is defined as the portion of said cylindrical stud between two of each said plurality of circumferential grooves, each of said plurality of weighted sections having a predetermined weight.

12. The Adjustable Archery Arrow Insert of claim 11, wherein said predetermined weight of said each of said plurality of weighted sections is between 1.00 grain and 3.00 grains.

13. The Adjustable Archery Arrow Insert of claim 8, wherein said arrow tip comprises:

a base;

a tip formed into said base; and a cylindrical stud formed into said base opposite said tip, said cylindrical stud formed with external threads corresponding to said internal threads of said arrow tip insert.

14. The Adjustable Archery Arrow Insert of claim 8, wherein said arrow tip insert threaded to said arrow tip collar forms an annular channel between said arrow tip insert and said arrow tip collar.

15. The Adjustable Archery Arrow Insert of claim 8, wherein said arrow tip is inserted through said arrow tip collar and threadably received by said arrow tip insert wherein said arrow tip is disposed outside of said arrow shaft.

* * * * *